US006577063B1

(12) United States Patent
Hsu et al.

(10) Patent No.: US 6,577,063 B1
(45) Date of Patent: Jun. 10, 2003

(54) PLASMA DISPLAY PANEL ENABLED TO TIGHTLY COMBINE TWO PLATES TOGETHER AND THE METHOD FOR FABRICATING THE SAME

(75) Inventors: Kuo-Pin Hsu, Chu-Pei (TW); Chien-Ho Lin, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 0 days.

(21) Appl. No.: 09/567,081

(22) Filed: May 8, 2000

(30) Foreign Application Priority Data

Mar. 17, 2000 (TW) ..... 89104907 A

(51) Int. Cl.[7] ..... H01J 17/49; H01J 1/90; H01J 9/26

(52) U.S. Cl. ..... 313/586; 313/482; 313/292; 445/25

(58) Field of Search ..... 313/581, 582, 313/583, 584, 585, 586, 587, 292, 495, 496, 497, 482; 445/25

(56) References Cited

U.S. PATENT DOCUMENTS 5,667,418 A * 9/1997 Fahlen et al. ..... 445/24
5,736,815 A * 4/1998 Amemiya ..... 313/584
5,746,635 A * 5/1998 Spindt et al. ..... 445/24
6,342,754 B1 * 1/2002 Kuroda et al. ..... 313/292
6,353,287 B1 * 3/2002 Sasaki et al. ..... 313/582

* cited by examiner

*Primary Examiner*—Nimeshkumar D. Patel
*Assistant Examiner*—Karabi Guharay
(74) *Attorney, Agent, or Firm*—Winston Hsu

(57) ABSTRACT

The present PDP includes a rear plate, a plurality of barrier ribs on the rear plate, and a front plate in parallel with the rear plate. The front plate includes a transparent dielectric layer, a plurality of joint notches on the transparent dielectric layer, and a protective layer on the transparent dielectric layer that covers the joint notches. The position of each of the joint notches is aligned with the position of one corresponding barrier rib, and each joint notch has a filler to affix within the joint notch corresponding the barrier rib. When the front plate is mounted onto the rear plate, the top of each of the barrier ribs of the rear plate is pushed through the protective layer and is embedded in the corresponding joint notch of the front plate. The filler within each of the joint notches fills the gap between the top of the barrier rib embedded in the joint notch and the joint notch so that the front plate is tightly fixed to the rear plate.

12 Claims, 7 Drawing Sheets

PLASMA DISPLAY PANEL ENABLED TO TIGHTLY COMBINE TWO PLATES TOGETHER AND THE METHOD FOR FABRICATING THE SAME

BACKGROUND OF THE INVENTION

1. Field of the Invention

The present invention relates to a plasma display panel (PDP) and the method for making the same, and more particularly, to a PDP having two plates tightly fixed together and the method for making the same.

2. Description of the Prior Art

With the continuing advances of the electronics industry, the consumer's demand for flat panel displays (FPD) has increased, with plasma display panels (PDP) having some of the greatest market potential of all FPDs. Typically, a front plate and a rear plate of a PDP are formed first, and the front plate is inverted for mounting onto the rear plate. The two plates are then sealed together to form closed discharge cells. The tightness of the sealing process can affect the yield of subsequent processes that remove gases from, or inject gases into, the PDP. Additionally, the sealing process may affect the isolation between each discharge cell. Hence, a method for tightly sealing the front plate and the rear plate is necessary.

Please refer to FIG. 1. FIG. 1 is a perspective view of a method for sealing a front plate 12 and a rear plate 14 of a PDP 10 according to the prior art. The prior art PDP 10 includes the front plate 12, the rear plate 14 in parallel with the front plate 12, and a plurality of barrier ribs 16 on a predetermined area of the rear plate 14.

In the prior art method for sealing the two plates, a sealing layer 18 is formed and surrounds the barrier ribs 16 on the rear plate 14, and a corresponding sealing layer 20 is also formed on the front plate 12. The front plate 12 and the rear plate 14 are affixed, and the sealing layer 18 and the sealing layer 20 temporarily bond to each other. The front plate 12 and the rear plate 14 are then placed into an oven and heated to 450° C. (842° F.), the frit within the sealing layers 18 and 20 are melted. After cooling, the front plate 12 and the rear plate 14 are tightly fixed together.

The PDP 10 is frequently used for displays with a large area. As the scale of the PDP increases, relying only on the sealing layers 18 and 20 is not sufficient to ensure a tight seal between the front plate 12 and the rear plate 14. This is especially true as it is not easy to align the sealing layers 18 and 20 when using the prior art method. Furthermore, the barrier ribs 16 are not all of the same height, which may allow some space between the front plate 12 and the top end of any barrier rib 16 that has a low height. This results in cross talk between two discharge cells, and reduces the isolation properties of the barrier ribs 16. However, if the width of the barrier rib 16 is increased to prevent cross talk, the number of the discharge cells must necessarily decrease due to limited size of the plates 12 and 14, preventing the construction of a high resolution PDP.

SUMMARY OF THE INVENTION

It is therefore a primary objective of the present invention to provide a PDP that has a front plate tightly fixed to the rear plate with a precise alignment so as to solve the above mentioned problems.

In a preferred embodiment of the present invention, the PDP includes a rear plate, a plurality of barrier ribs on the rear plate, and a front plate in parallel with the rear plate. The front plate includes a transparent dielectric layer, a plurality of joint notches on the transparent dielectric layer, and a protective layer on the transparent dielectric layer that covers the joint notches. The position of each of the joint notches is aligned with the position of a corresponding barrier rib, and each joint notch has a filler that is used to fix the joint notch and the corresponding barrier rib. When the front plate is mounted onto the rear plate, the top end of each of the barrier ribs of the rear plate is pushed through the protective layer above the corresponding joint notch on the transparent dielectric layer and is embedded in the corresponding joint notch of the front plate. The filler in each of the joint notches fills the gap between the top end of the barrier rib embedded in the joint notch and the joint notch so that the front plate is tightly fixed to the rear plate.

It is an advantage of the present invention that each of the barrier ribs is embedded in a corresponding joint notch. the fillers are used to seal the two plates together tightly, greatly increasing the sealing strength of the present invention PDP, and ensuring that there are no gaps between the top ends of the barrier ribs and their joint notches. Furthermore, the front plate and the rear plate can be easily aligned.

These and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 2:
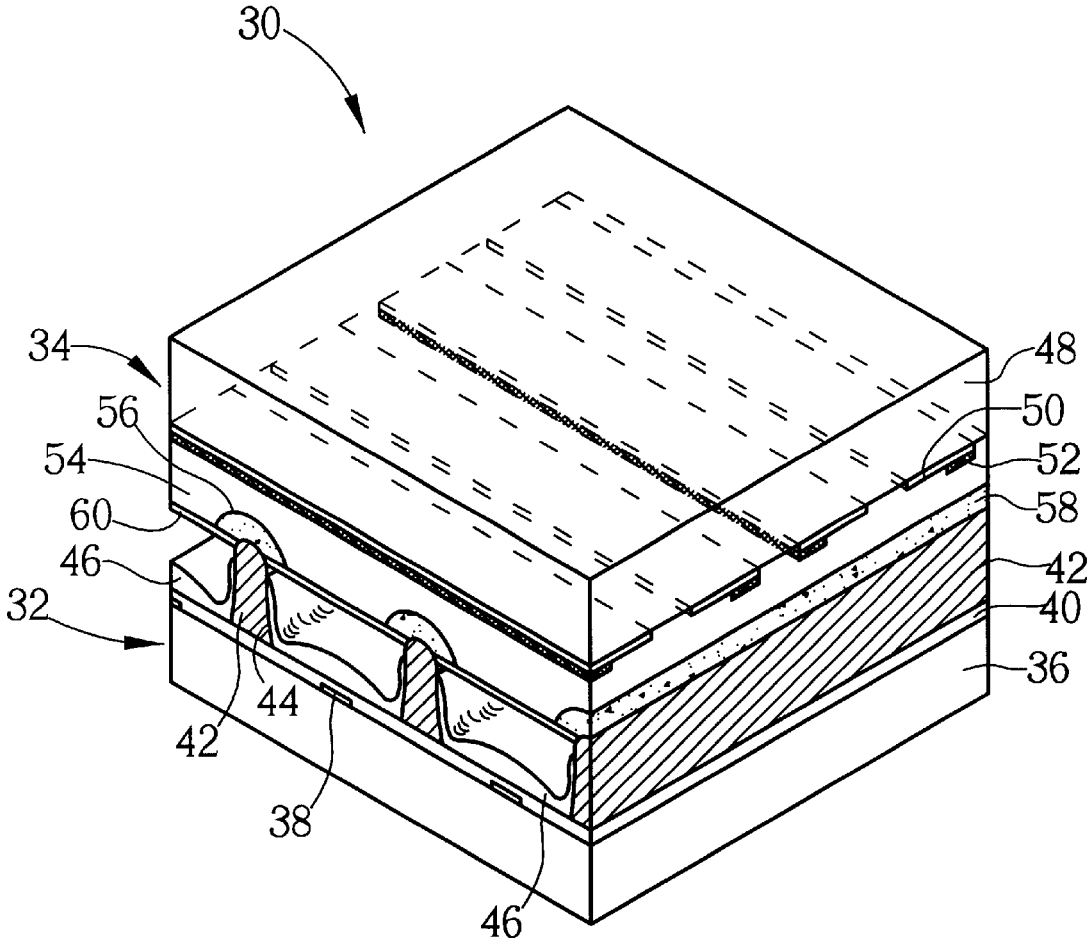
FIG. 2 is a perspective view of the method for tightly sealing a front plate and a rear plate of a PDP according to the present invention.

Please refer to FIG. 2. FIG. 2 is a perspective view of the plasma display panel (PDP) 30 manufactured by tightly sealing the front plate 34 and the barrier ribs 42 on the rear plate 32 according to the present invention. The PDP 30 includes the rear plate 32 and the front plate 34 mounted on and in parallel with the rear plate 32. The rear plate 32 includes a rear glass substrate 36, a first surface (not shown) on the rear glass substrate 36, a plurality of data electrodes 38 formed on the first surface of the rear glass substrate 36, and an overcoat dielectric layer 40 covering the first surface and the data electrodes 38. The overcoat dielectric layer 40 is used to protect the data electrodes 38. The rear plate 32 further includes a plurality of barrier ribs 42 formed on the first surface of the rear glass substrate 36, and a plurality of phosphor layers 46 that fill the trenches 44 formed between two neighboring barrier ribs 42.

The front plate 34 includes a front glass substrate 48, a second surface (not shown) on the front glass substrate 48, a plurality of sustaining electrodes 50 formed on the second surface of the front glass substrate 48, a plurality bus electrodes 52 formed on the sustaining electrodes 50, and a transparent dielectric layer 54 covering the sustaining electrodes 50 and the bus electrodes 52 to protect the sustaining electrodes 50. The second surface of the front plate 34 is faced to the first surface of the rear plate 32.

The PDP 30 in the present invention includes a plurality of joint notches 56 formed on the transparent dielectric layer 54, and the position of each of the joint notch 56 is aligned with the position of one corresponding barrier rib 42. The width of each joint notch 56 is about 120 $\mu$m to 150$\mu$m, and its depth is about 20 $\mu$m . The width of each barrier rib 42 is about 70 $\mu$, and its height is about 10 $\mu$m to 20 $\mu$m larger than the distance between the front plate and the rear plate. Each joint notch 56 is filled with the filler 58 for affixing a corresponding barrier rib 42 in the notch 56. A protective layer 60 is formed on the transparent dielectric layer 54, and is typically made of magnesium oxide (MgO). During the manufacturing process, the protective layer 60 is used to maintain the quality of the transparent dielectric layer 54, and also cover the joint notches 56 with their fillers 58.

Figure 1:
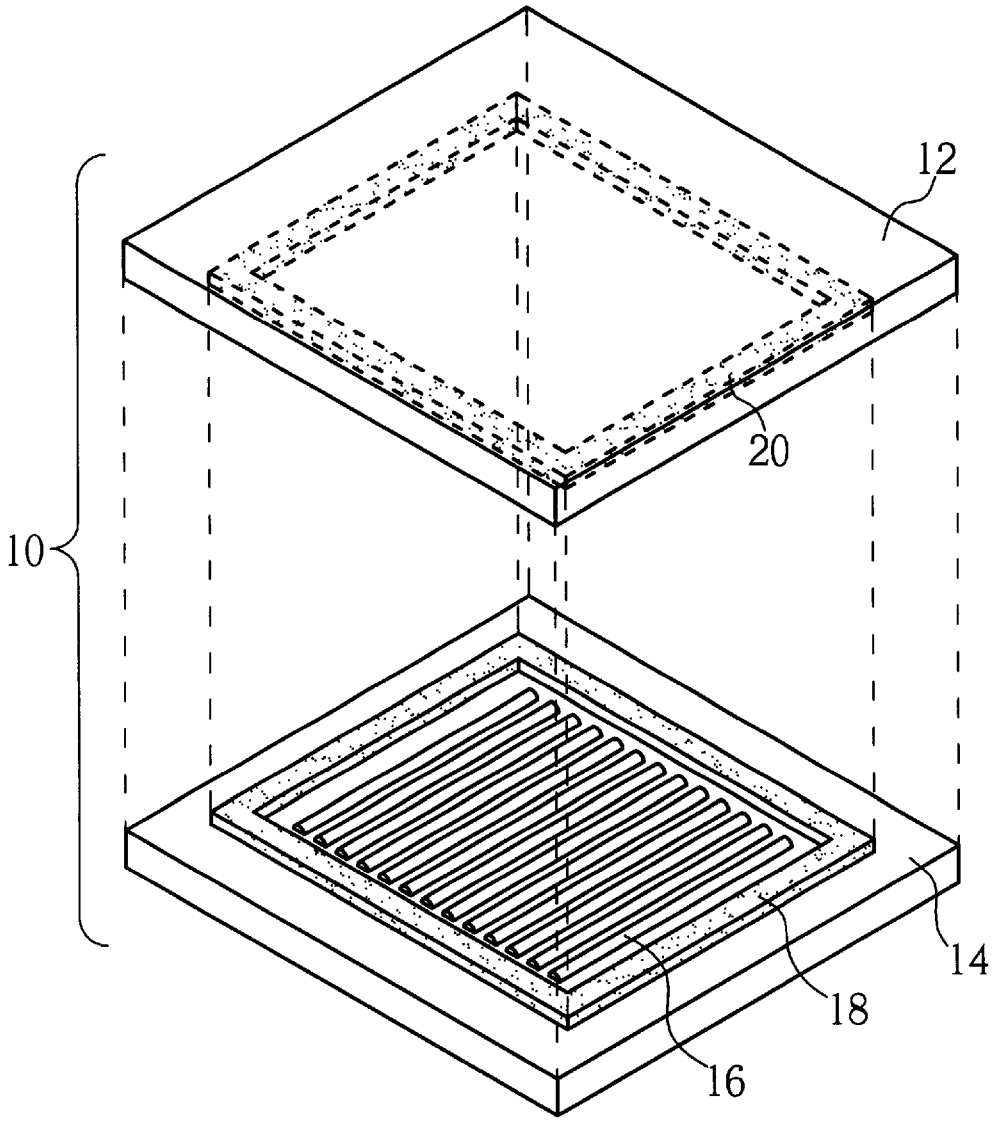
Fig. 1 Prior art
FIG. 1 is a perspective view of the method for sealing a front plate and a rear plate of a PDP according to the prior art.
Figure 6:
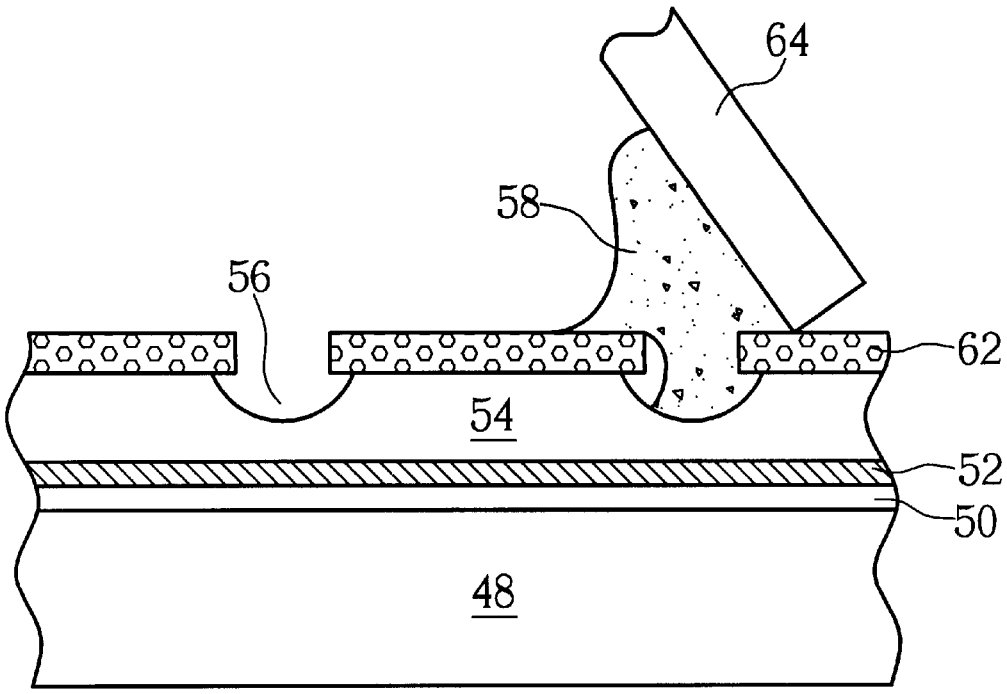
Figure 11:
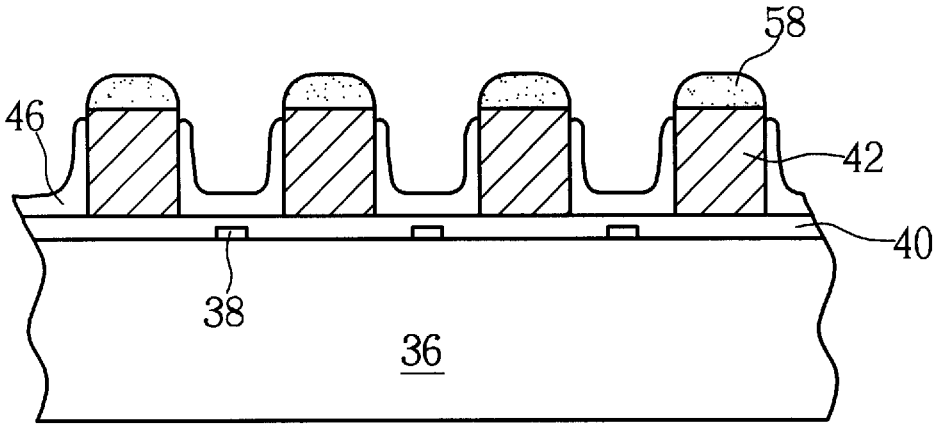

The softening point of the filler 58 is lower than the necessary temperature for performing the sealing process of FIG. 1. When the filler 58 has cooled after the sealing process, the barrier ribs 42 are affixed within the joint notches 56 by the filler 58. Generally, the filler 58 is made of sealing frit, or material similar to the barrier rib 42. There is no limitation in selecting colors for the fillers 58. However, in order to increase the brightness contrast of the video display on the PDP 30, a black or dark-colored sealing frit or rib material is preferred. There are several ways to make the filler 58 filled within the joint notches 56: (a) As shown in FIG. 6, the filler 58 is formed by a squeegee to directly fill each joint notch 56 with filler material. (b) As shown in FIG. 11, the filler 58 can be formed on the top surface of the barrier ribs 42 during the formation of the rear plate 32. When the subsequent sealing process is performed, the filler 58 is embedded into its respective joint notch 56. (c) The filler 58 may be simultaneously formed within the joint notches 56 and on the top surface of the barrier ribs 42, and then combined together later.

When sealing the PDP 30, that is, when the front plate 34 is mounted onto the rear plate 32, the top end of each of the barrier ribs 42 of the rear glass substrate 36 is embedded into the corresponding joint notch 56 of the front plate 34. The filler 58 in each of the joint notches 56 fills up the gap formed between the barrier rib 42 and the corresponding joint notch 56 so that the rear plate 32 and the barrier ribs 42 are tightly affixed to the front plate 34. Because the barrier ribs 42 are embedded within the joint notches 56 of the front plate 34, there is no gap existing between the barrier rib 42 and the front plate 34. Hence, the barrier ribs 42 can perfectly isolate the plasma discharge among neighboring discharge cells and the cross talk effect among the neighboring discharge cells is reduced.

Please refer to FIG. 3 to FIG. 8. FIG. 3 to FIG. 8 are side views of the first manufacturing process of forming the joint notches 56 and filling the filler 58 into the notches 56. The front plate 34 and the rear plate 32 are independently formed first. The joint notches 56 on the front plate 34, and the filler 58 within the joint notches 56 are then formed. The front plate 34 and the rear plate 32 are then sealed together to form the PDP 30.

Figure 3:
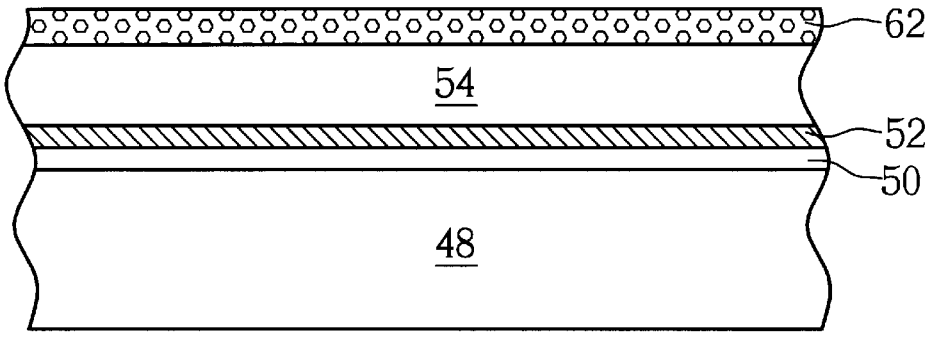
FIG. 3 to FIG. 8 are side views of forming the joint notches and the fillers shown in FIG. 2.

The data electrodes 38, the dielectric layer 40, the barrier ribs 42 and the phosphor layer 46 are sequentially formed on the rear glass substrate 36 to form the rear plate 32 shown in FIG. 2. In the method of constructing the front plate 34 as shown in FIG. 3, the sustaining electrodes 50 and the bus electrodes 52 are formed on the front glass substrate 48. The transparent dielectric layer 54 is then covered over the sustaining electrodes 50 and the bus electrodes 52. A dry film photoresist 62 is then coated onto the surface of the transparent dielectric layer 54.

Figure 4:
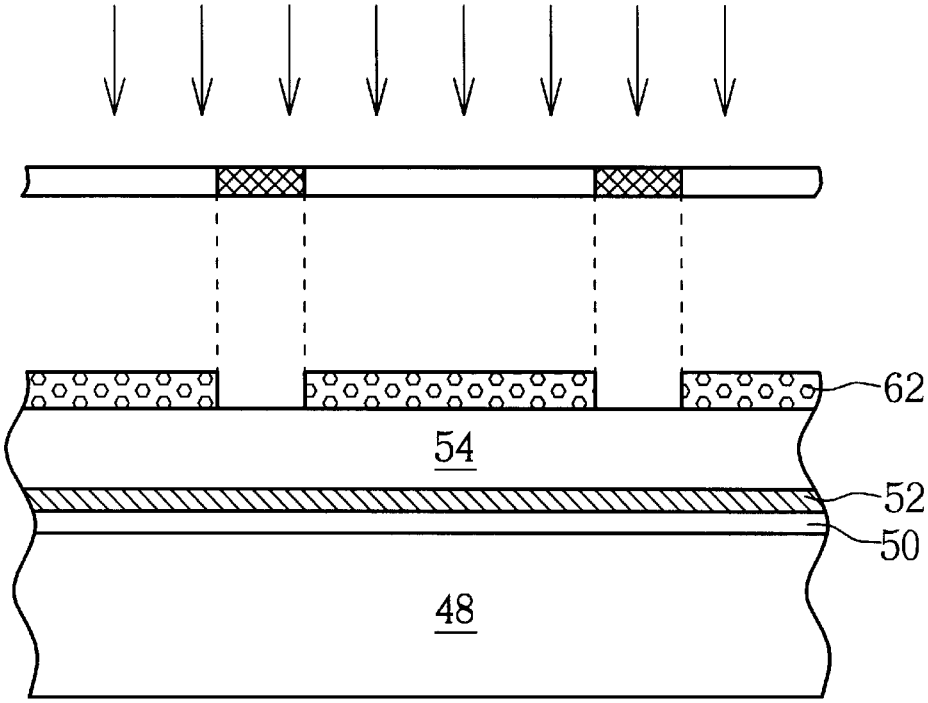
Figure 5:
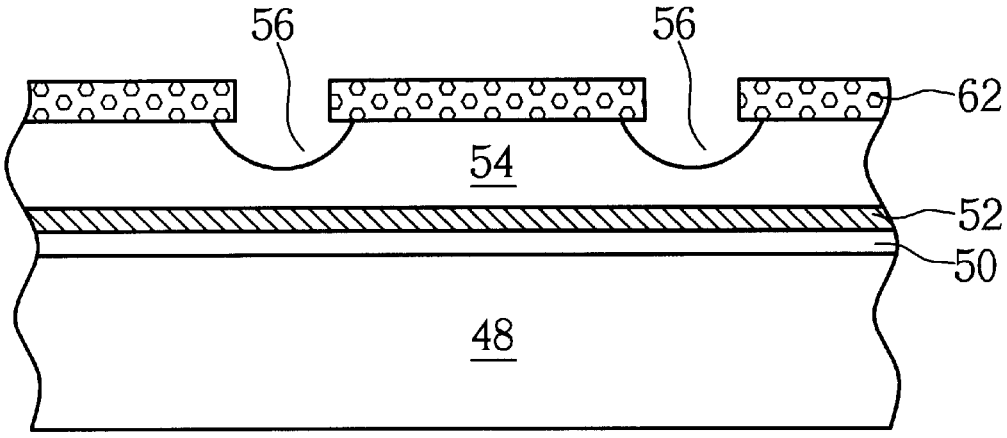

As shown in FIG. 4, an exposure and develop process is performed to define the pattern of the joint notches 56. As shown in FIG. 5, a wet etching process is performed on the transparent dielectric layer 54 to form the joint notches 56. As shown in FIG. 6, a squeegee 64 is used to fill the filler 58 into each joint notch 56, and the front glass substrate 48 is heated to 120° C. to 150° C. (248° F. to 302° F.) to increase the adhesions between the fillers 58 and the transparent dielectric layer 54.

Figure 7:
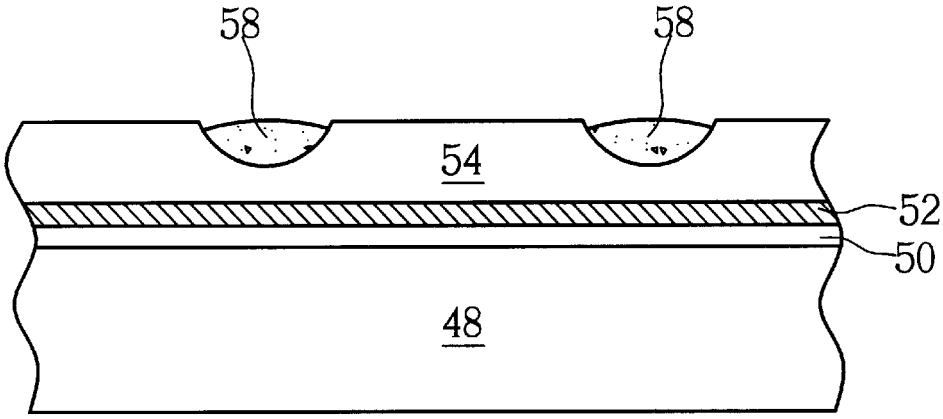

As shown in FIG. 7, the dry film photoresist 62 is removed. Because the fillers 58 have been heated, the fillers 58 are not stripped.with the photoresist 62. The front glass substrate 48 is then placed into an oven and heated to about 370° C. (698° F.). The purpose of this heating process is to further increase the adhesion between the fillers 58 and the transparent dielectric layer 54. Thus, when the front plate 34 is inverted later for mounting onto the rear plate 32, the filler 58 will remain inside the joint notches 56.

Figure 8:
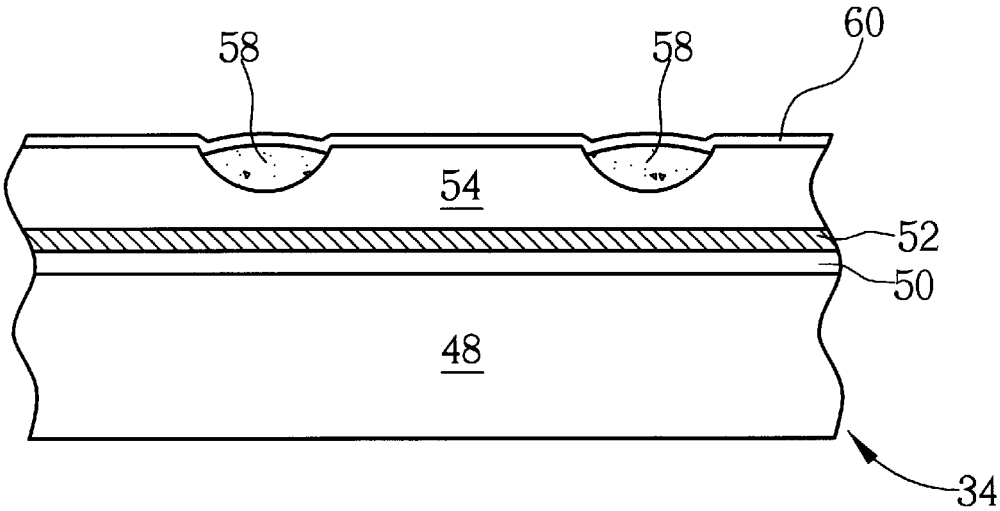

As shown in FIG. 8, an evaporation process is finally performed to form an even magnesium oxide layer 60 on the surface of the front plate 34 so as to finish the formation of the front plate 34. The magnesium oxide layer 60 is used to cover the transparent dielectric layer 54, and the filler 58 inside the joint notches 56.

After the front plate 34 and the rear plate 32 are already formed, the sealing layer 18 as shown in FIG. 1 is formed between the rear plate 32 and front plate 34 to further ensure the periphery of the two plates to be tightly sealed together. After forming the sealing layers, a sealing process is performed to temporarily seal the front plate 34 and the rear plate 32. Because each of the joint notches 56 on the front plate 34 aligns with one corresponding barrier rib 42, the front plate 34 can be easily aligned with the rear plate 32.

The front plate 34 and the rear plate 32 are then placed into an oven and heated to 420° C. to 430° C. (788° F. to 806° F.). Because the barrier ribs 42, the fillers 58 and the transparent dielectric layer 54 all comprise similar frit material, these three originally separately formed structures will be melt together into a single structure. After cooling, the barrier ribs 42 and the filler 58 are tightly affixed within the joint notches 56 formed on the transparent dielectric layer 54. The front plate 34 and the rear plate 32 are thus tightly fixed together to form the PDP 30 shown in FIG. 2.

Figure 9:
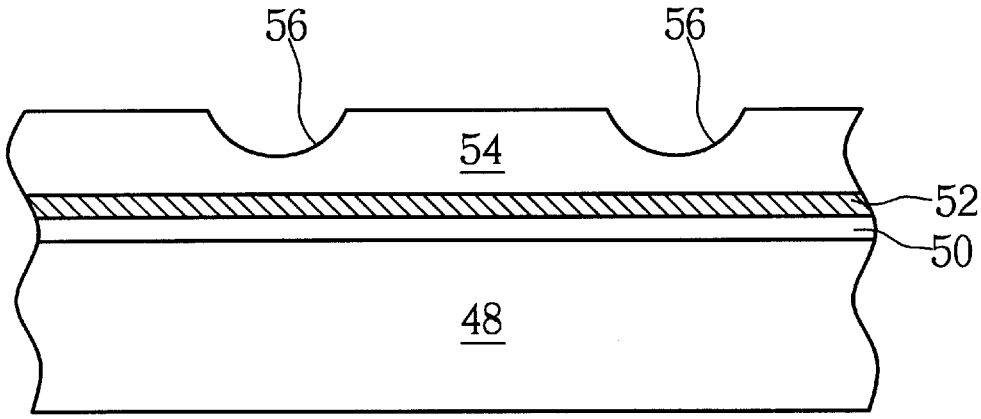
FIG. 9 to FIG. 11 are side views of another embodiment of forming joint notches and fillers shown in FIG. 2.
Figure 10:
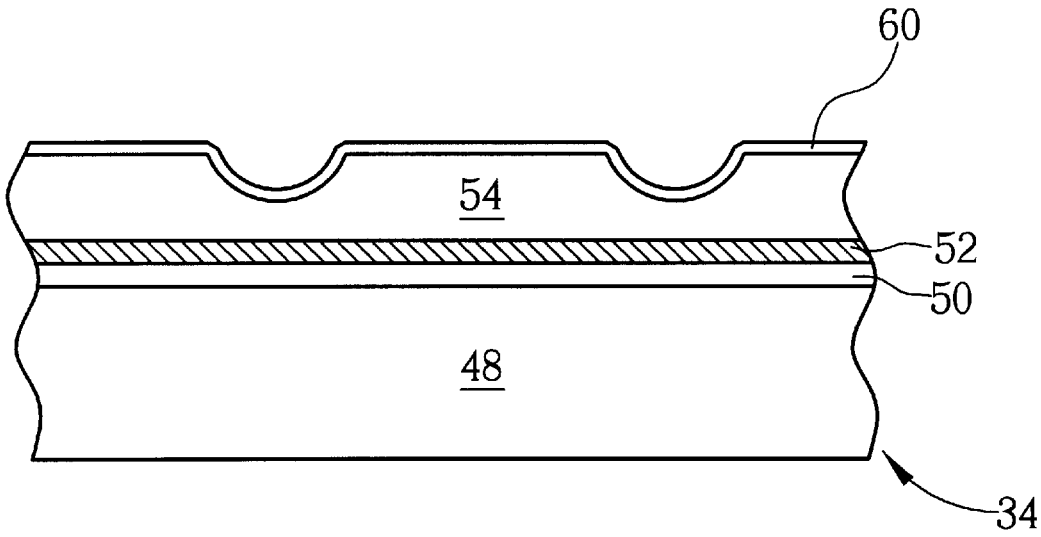

Please refer to FIG. 9 to FIG. 11. FIG. 9 to FIG. 11 are side views of another embodiment of forming joint notches 56 and filler 58 shown in FIG. 2. In the second embodiment, the filler 58 is formed on the top surface of each barrier rib 42.

In the second embodiment, the process flow of the front plate 34 before filling the filler 58 into the front plate 34 is same as that in the first embodiment. That is, the processes shown in FIG. 3 to FIG. 5 are also performed first in the second embodiment.

As shown in FIG. 9, a wet etching process is performed to form joint notches 56 on the transparent dielectric layer 54, and the dry film photoresist 62 is then stripped.

As shown in FIG. 10, an evaporation process is performed to form an even magnesium oxide layer 60 on the surface of the front plate 34 so as to finish the formation of the front plate 34.

As shown in FIG. 11, the method for forming the rear plate 36 is similar to that in the first embodiment. The data electrodes 38, the dielectric layer 40, the barrier ribs 42 and the phosphor layers 46 are formed on the glass substrate 36. A screen printing process is then performed to form the filler 58 on the top surfaces of the barrier ribs 42. Finally, similar to the 420° C. to 430° C. heating process applied in the first embodiment, the front plate 34 (shown in FIG. 10) is sealed with the rear plate 36 (shown in FIG. 11) to form the PDP 30 shown in FIG. 2.

The PDP 30 according to the present invention has many advantages: (1) Each of the barrier ribs 42 is tightly affixed within each joint notch 56 on the front plate 34, increasing the sealing strength of the two plates. (2) The joint notches 56 formed on the transparent dielectric layer 54 makes the front plate 34 easier to align with the rear plate 32. (3) The dark color filler 58 can prevent the color-mixing phenomenon caused by adjacent phosphor materials. (4) There is no gap formed between the barrier ribs 42 and the front plate 34, the cross talk effect among neighboring discharge cells is reduced. Therefore, the pitch of the barrier ribs 42 can be reduced to enhance the resolution of the PDP 30.

In contrast to the prior art method for sealing the PDP 10, the barrier ribs 42 are embedded in the joint notches 56 in the present invention PDP 30, and filler 58 is used to form a tight seal so that the sealing strength of the present invention PDP 30 is greater than that of the prior art PDP 10. Also, the present invention PDP 30 has no gap formed between the barrier ribs and the front plate. Furthermore, the barrier ribs 42 and the corresponding joint notches 56 used in the present invention PDP 30 improve the alignment of the front and rear plates.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A plasma display panel (PDP) comprising:

a first plate having a plurality of barrier ribs on the surface of the first plate; and a second plate having a plurality of joint notches on the surface of the second plate, the position of each joint notch being aligned with the position of each barrier rib, and a filler formed inside each joint notch;

wherein when the second plate is mounted onto the first plate, the top of the barrier rib of the first plate embeds into the joint notch of the second plate, and the filler of each joint notch fills a gap between the barrier rib embedded in the joint notch and the joint notch so as to tightly combine the first plate with the second plate.

2. The PDP of claim 1 wherein the filler is a sealing frit.

3. The PDP of claim 1 wherein the filler is a rib material.

4. The PDP of claim 1 wherein a transparent dielectric layer is positioned on the second plate and the pluralities of joint notches are located on the transparent dielectric layer.

5. The PDP of claim 4 wherein a protective layer is positioned on the transparent dielectric layer, when the second plate is fixed onto the first plate, the top of the barrier rib of the first plate thrusts through the protective layer, and then embeds into the joint notch of the second plate.

6. A plasma display panel (PDP) comprising:

a first plate having a plurality of barrier ribs on the surface of the first plate, and a filler coated on the top of each barrier rib; and a second plate having a plurality of joint notches on the surface of the second plate, the position of each joint notch being aligned with the position of each barrier rib:

wherein when the second plate is mounted onto the first plate, the top of the barrier rib of the first plate embeds into the joint notch of the second plate, and the filler of each barrier rib fills a gap between the barrier rib embedded in the joint notch and the joint notch so as to tightly combine the first plate with the second plate.

7. A plasma display panel (PDP) comprising:

a first plate having a first surface;

a plurality of barrier ribs formed on the first surface: and a second plate having a second surface, the second surface facing the first surface, a plurality of joint notches formed on the second surface, and a filler formed inside each joint notch;

wherein each of the plurality of joint notches is formed to correspond to each barrier rib formed on the first surface, and when the second plate is mounted onto the first plate, each of the barrier ribs embeds into one corresponding joint notch of the second plate, the filler of each joint notch filling a gap between the barrier rib embedded in the joint notch and the joint notch so as to tightly combine the first plate with the second plate.

8. The PDP of claim 7 wherein the filler is a sealing frit.

9. The PDP of claim 7 wherein the filler is a rib material.

10. The PDP of claim 7 wherein a transparent dielectric layer is positioned on the second plate and the pluralities of joint notches are located on the transparent dielectric layer.

11. The PDP of claim 10 wherein a protective layer is positioned on the transparent dielectric layer, when the second plate is fixed onto the first plate, the top of the barrier rib of the first plate thrusts through the protective layer, and then embeds into the joint notch of the second plate.

12. A plasma display panel comprising:

a first plate having a first surface;

a plurality of barrier ribs formed on the first surface;

a filler coated on the top of each barrier rib; and a second plate having a second surface, the second surface facing the first surface, and a plurality of joint notches formed on the second surface;

wherein each of the plurality of joint notches is formed to correspond with each barrier rib formed on the first surface, and when the second plate is mounted onto the first plate, each of the barrier ribs embeds into one corresponding joint notch of the second plate, the filler of each barrier rib fills a gap between the barrier rib embedded in the joint notch and the joint notch so as to tightly combine the first plate with the second plate.

* * * * *